US006069550A

United States Patent [19]

Huang

[11] Patent Number: 6,069,550

[45] Date of Patent: May 30, 2000

[54] STRUCTURE OF CONNECTING PINS OF A TRANSFORMER REEL

[76] Inventor: Sheng Min Huang, 3F, No. 16, Lane 21, Wu Feng Rd., Pan Chiao, Taipei Hsien, Taiwan

[21] Appl. No.: 09/122,065

[22] Filed: Jul. 24, 1998

[51] Int. Cl.[7] ..... H01F 27/29

[52] U.S. Cl. ..... 336/192; 336/107

[58] Field of Search ..... 439/736; 336/192, 336/198, 107, 65

[56] References Cited

U.S. PATENT DOCUMENTS 3,562,903 2/1971 Busler et al. ..... 336/192
5,008,644 4/1991 Cooper ..... 336/192
5,165,056 11/1992 Chien-heng ..... 336/65

*Primary Examiner*—Lincoln Donovan
*Assistant Examiner*—Tuyen T. Nguyen
*Attorney, Agent, or Firm*—Rosenberg, Klein & Lee

[57] ABSTRACT

An improved structure of connecting pins of a transformer reel is disclosed. The transformer reel includes a reel body and a polarity of connecting pins formed by punching. The connecting pins has a respective connecting pin body the lower surface of which is oblique for forming a lower point so to be welded on a PC board, and a supporting frame is extended from the connecting pin body for fixing the end portion of a winding. Another, the reel body is formed by injecting and is combined with the connecting pins. By the aforementioned structure, the manufacturing process may be simplified, the cost is reduced, and the ill ratio is improved.

4 Claims, 9 Drawing Sheets

STRUCTURE OF CONNECTING PINS OF A TRANSFORMER REEL

BACKGROUND OF THE INVENTION

1. Field of the Invention

The present invention relates to an improved structure of connecting pins of a transformer reel which has a simply manufacturing process, a lower manufacturing cost and a preferred horizontal level.

2. Background of the Invention

As shown in FIG. 1, the transformer reel in the prior art includes a reel body 10*a*, and a plurality of connecting pins 11*a*. During manufacturing the transformer reel, at first, the connecting pins are made by punching a metal piece continuously. The connecting pins 11*a* are spaced with a predetermined distance and connect with a material belt (not shown in figure). Then the reel body 10*a* is combined with the connecting pins 11*a* by injection molding, and the connecting pin 11*a* on the two sides of the reel body 10*a* is plated (with tin). Next, the material is cut. Finally, the connecting pins 11*a* on the two sides of the reel body 10*a* is bent to form a desired shape. Thus a transformer reel is formed. Another, as shown in FIG. 2, the connecting pins 11*a* of the transformer reel may be varied.

However, the prior-art connecting pins of the transformer reel has the following defects:

1. In manufacturing, five steps are need: punching connecting pins 11*a*, injection the reel body 10*a*, plating the connecting pin 11*a*, cutting the material belt and bending the connecting pins 11*a*. The production and manufacturing procedures are very complex, so that the manufacturing cost is increased greatly. Also, after plating the connecting pin 11*a*, the material belt is cut, a cutting cross section will generate on the connecting pin 11*a*, and the part without plating with tin will cause the connecting pin 11*a* to oxidize.
2. The connecting pins 11*a* of the reel body 10*a* must be spaced with a predetermined distanced, thus the different connecting pins are spaced with a distance and connect with the material belt. Since different connecting pins 11*a* can not be tightly adjacent with each other, naturally the material belt is wasted. Further, when the reel body 10 has been injected on the connecting pin 11*a*, two reel bodies is spaced with a predetermined distance, therefore, the material belt and the connecting pins between the reel bodies will become waste. Another, for different products, the distance between the connecting pins 11*a* of the reel body 10*a* are different, thus the molds for punching, cutting and bending are all different according the specifications. Therefore, the product cost is increased.
3. The bending connecting pin 11*a* has a poor horizontal level. Another, if they are welded on the PC board by surface adhering technology, the welding will be difficult.

SUMMARY OF THE INVENTION

Accordingly, the object of the present invention is to provide an improved structure of connecting pins of a transformer reel is disclosed. The transformer reel includes a reel body and a plurality of connecting pins formed by punching. The connecting pins has a respective connecting pin body the lower surface of which is oblique for forming a lower point for being welded on a PC board, and a supporting frame is extended from the connecting pin body for fixing the end portion of a winding. Another, the reel body is formed by injection molding and is combined with the connecting pins. By the aforementioned structure, the manufacturing process may be simplified, the cost is reduced, and the horizontal level is improved. In manufacturing, only three steps are needed, including the punching of the connecting pins, the plating of the connecting pins and the injection of the reel body. Thus, the process is simple and manufacturing cost may be reduced greatly. The different connecting pins may be tightly adjacent with each other on the material belt, therefore, the material is saved. Furthermore, the connecting pins are directly made by punching, so it needs not to be bent. Thus, it has a preferred horizontal level.

The present invention will be better understood and its numerous objects and advantages will become apparent to those skilled in the art by referencing to the following drawings in which:

DETAILED DESCRIPTION OF THE PREFERRED EMBODIMENT

Figure 1:
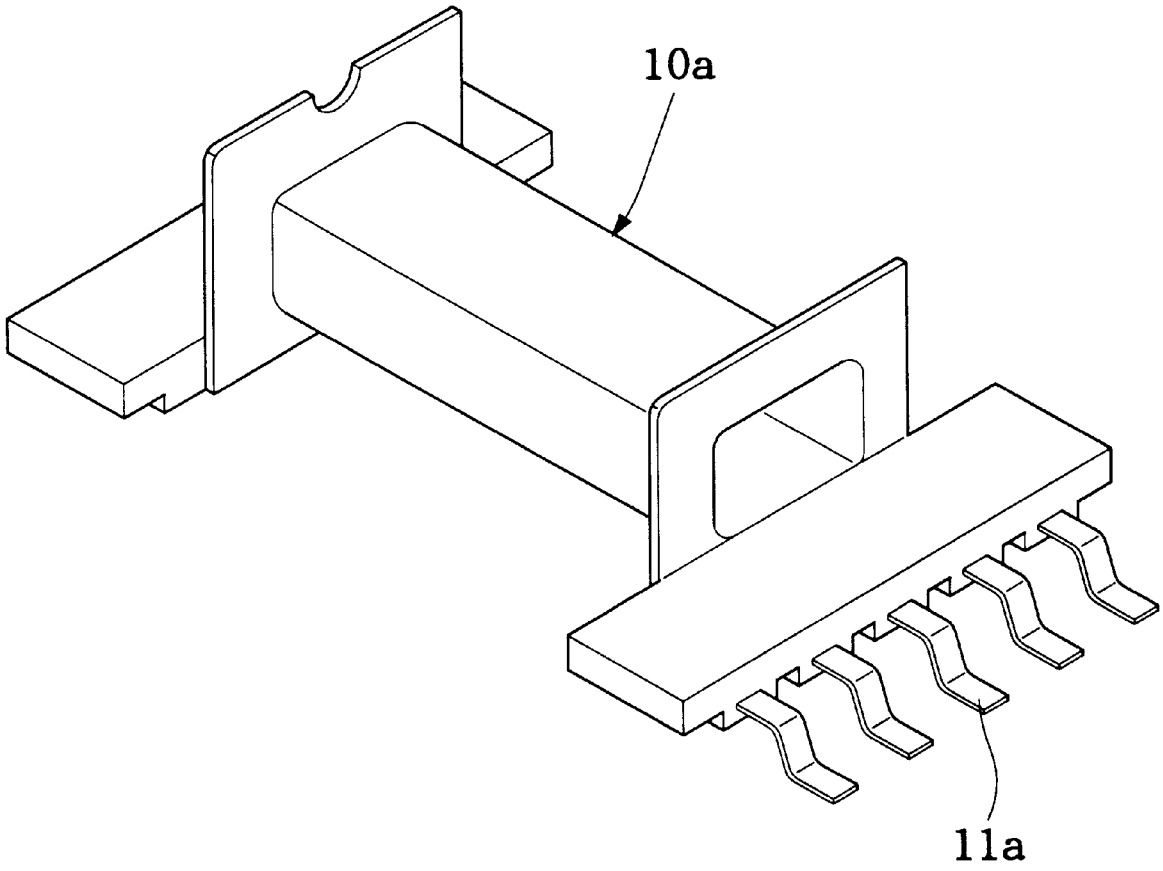
FIG. 1 PRIOR ART
FIG. 1 is a perspective view of the transformer reel in the prior art.
Figure 2:
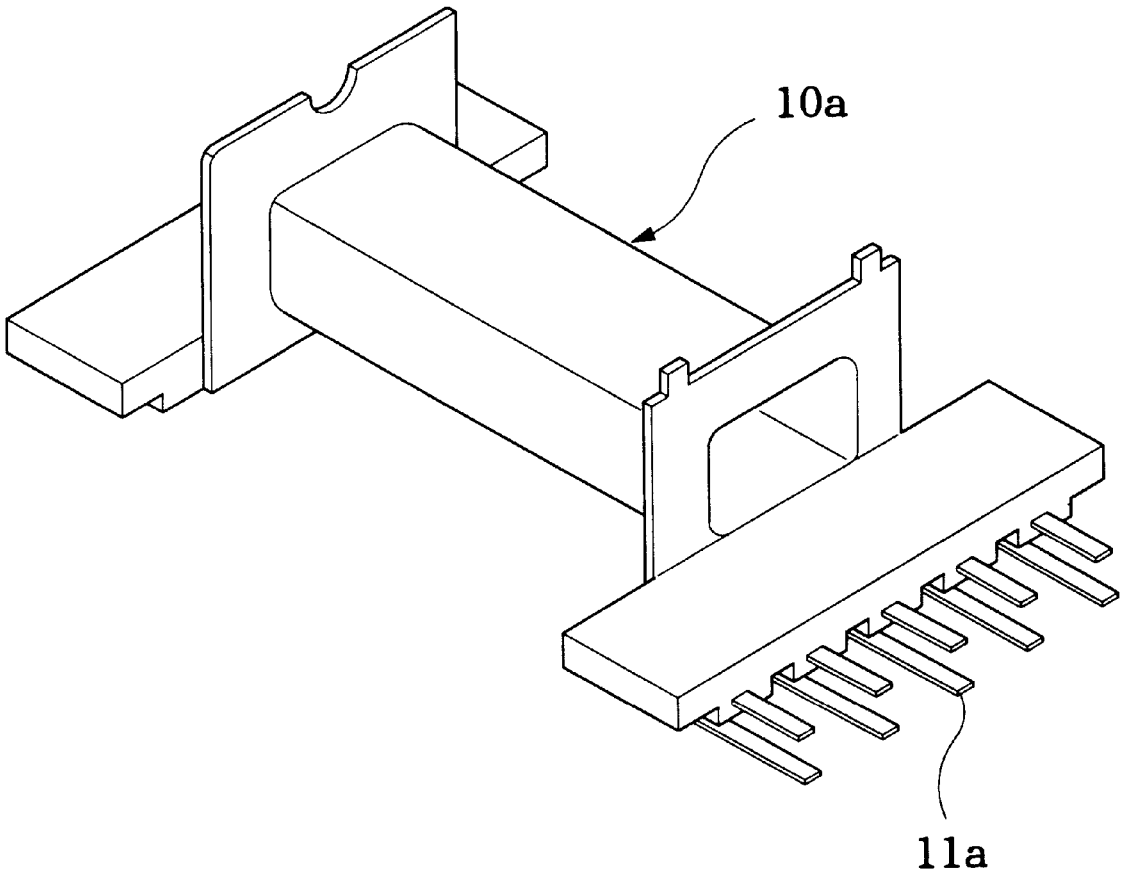
FIG. 2 PRIOR ART
FIG. 2 is a perspective view of another transformer reel in the prior art.
Figure 3:
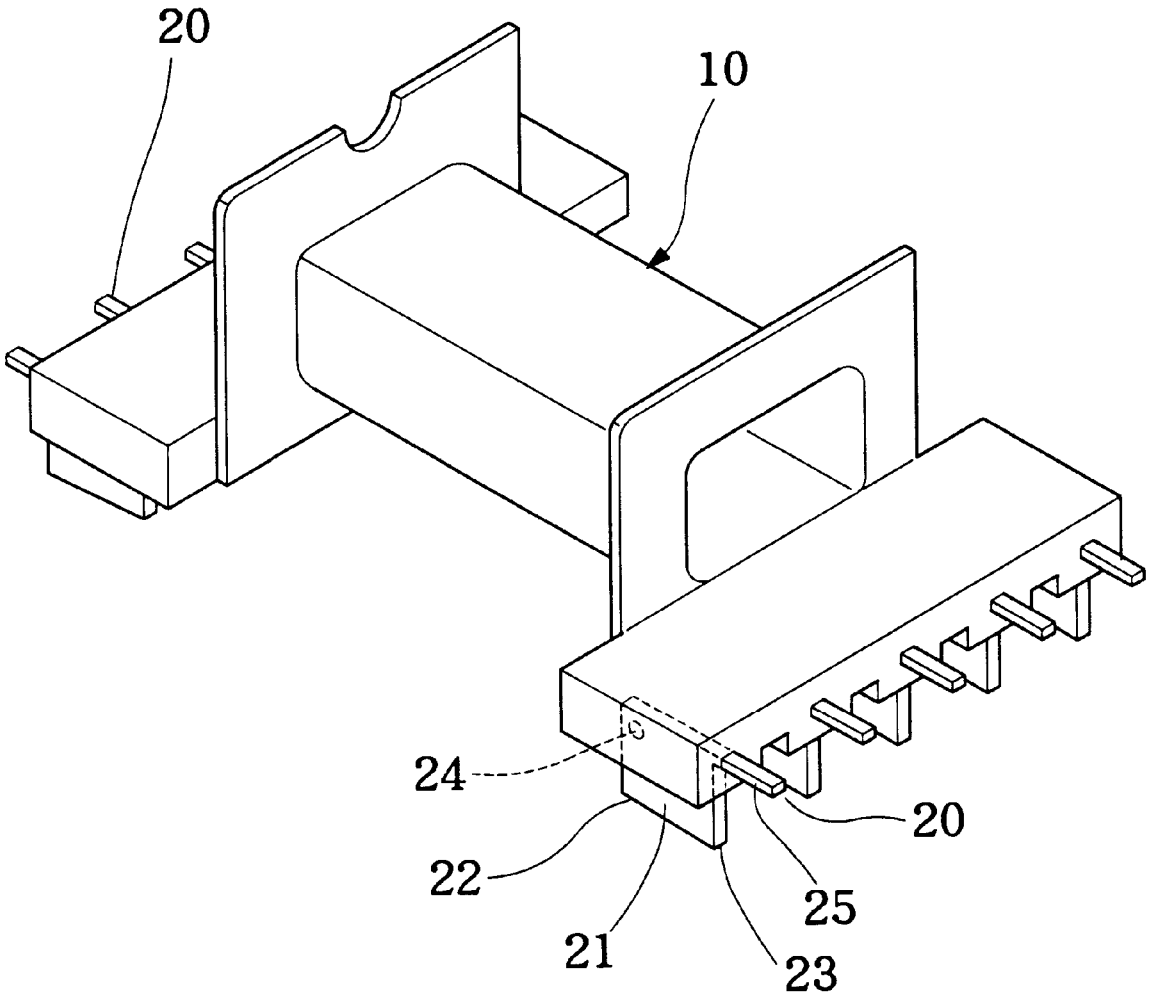
FIG. 3 is a perspective view of the present invention.
Figure 4:
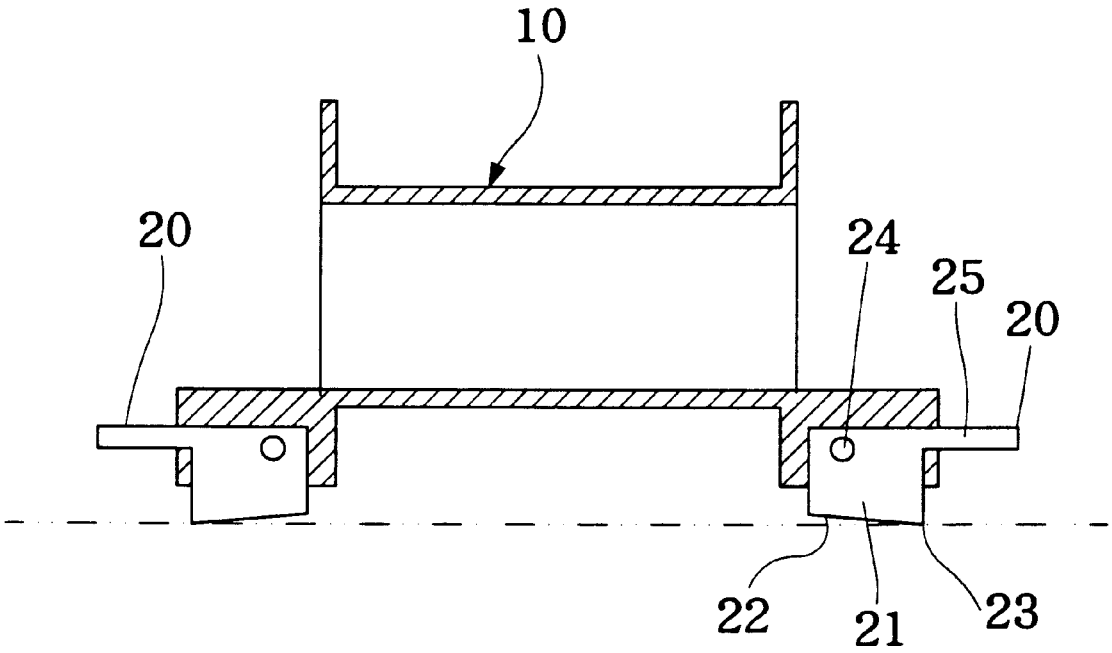
FIG. 4 is a cross section view of the present invention.
Figure 5:
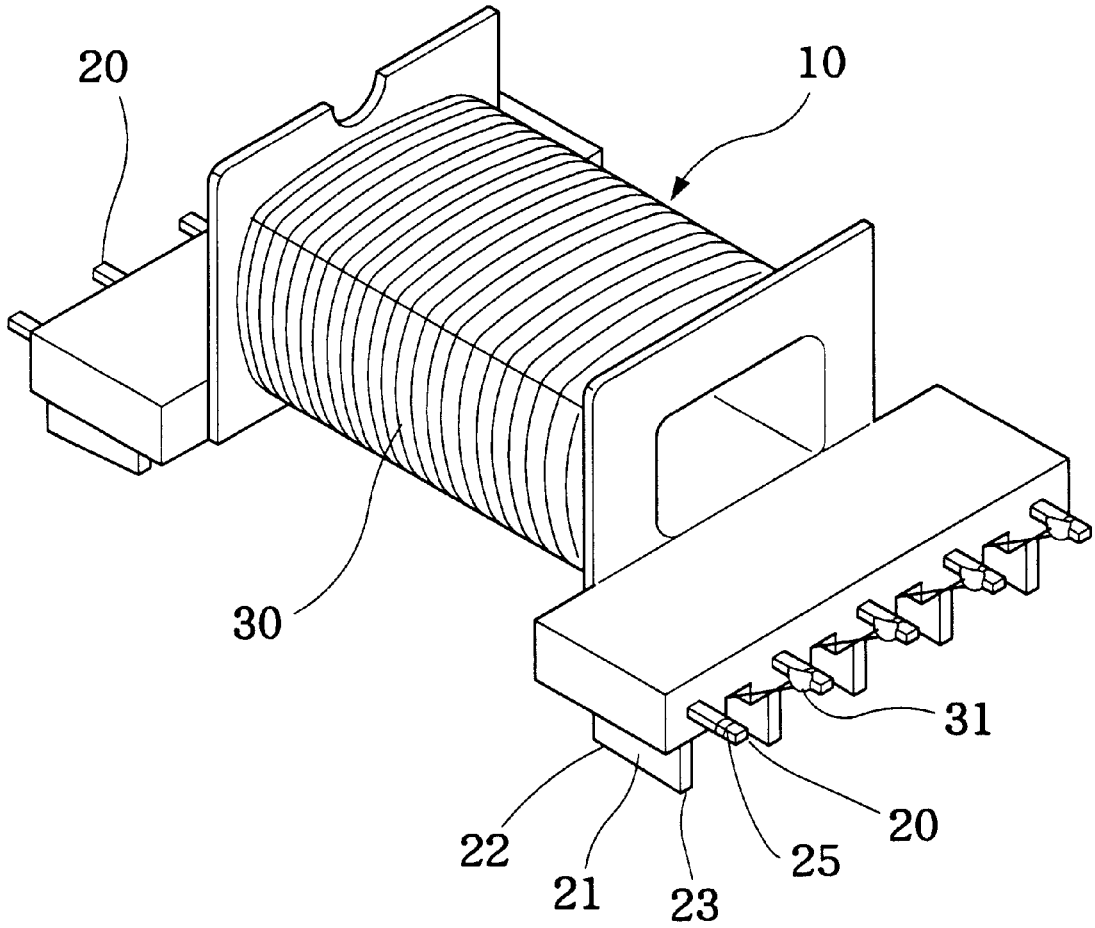
FIG. 5 is a perspective view of the present invention after winding.

As shown in FIGS. 3, 4 and 5, a connecting pin structure of a transformer reel is disclosed. The transformer reel comprises a reel body 10 and a plurality of connecting pins 20 combining on the two sides of the reel body 10 for being welded on a PC board. The connecting pins 20 has a connecting pin body 21 of piece shape, while the lower surface 22 of the connecting pin body 21 is inclined so that a lower point 23 is formed on the lower surface 22. At least one rabbet 24 is installed on the connecting pin body 21 so that when the reel body 10 is formed by injection. The connecting pins 20 may be inserted into the reel body 10 for preventing the releasing between the reel body 10 and the plurality of connecting pins 20. Horizontal supporting frames 25 is extended from the reel body 21 for fixing the end portion of the reel.

In manufacturing the transformer reel, at first, the individual connecting pin 20 are manufacturing by punching and then they are plated, next, the reel body 10 is adhered on the connecting pins 20 by injection molding, therefore, a transformer reel is formed. The reel 30 may be wound on the reel body 10, and the end portion 31 of the reel 30 may be wound on the support frames 25 of the connecting pins 20, and finally they are welded for fixing.

Figure 6:
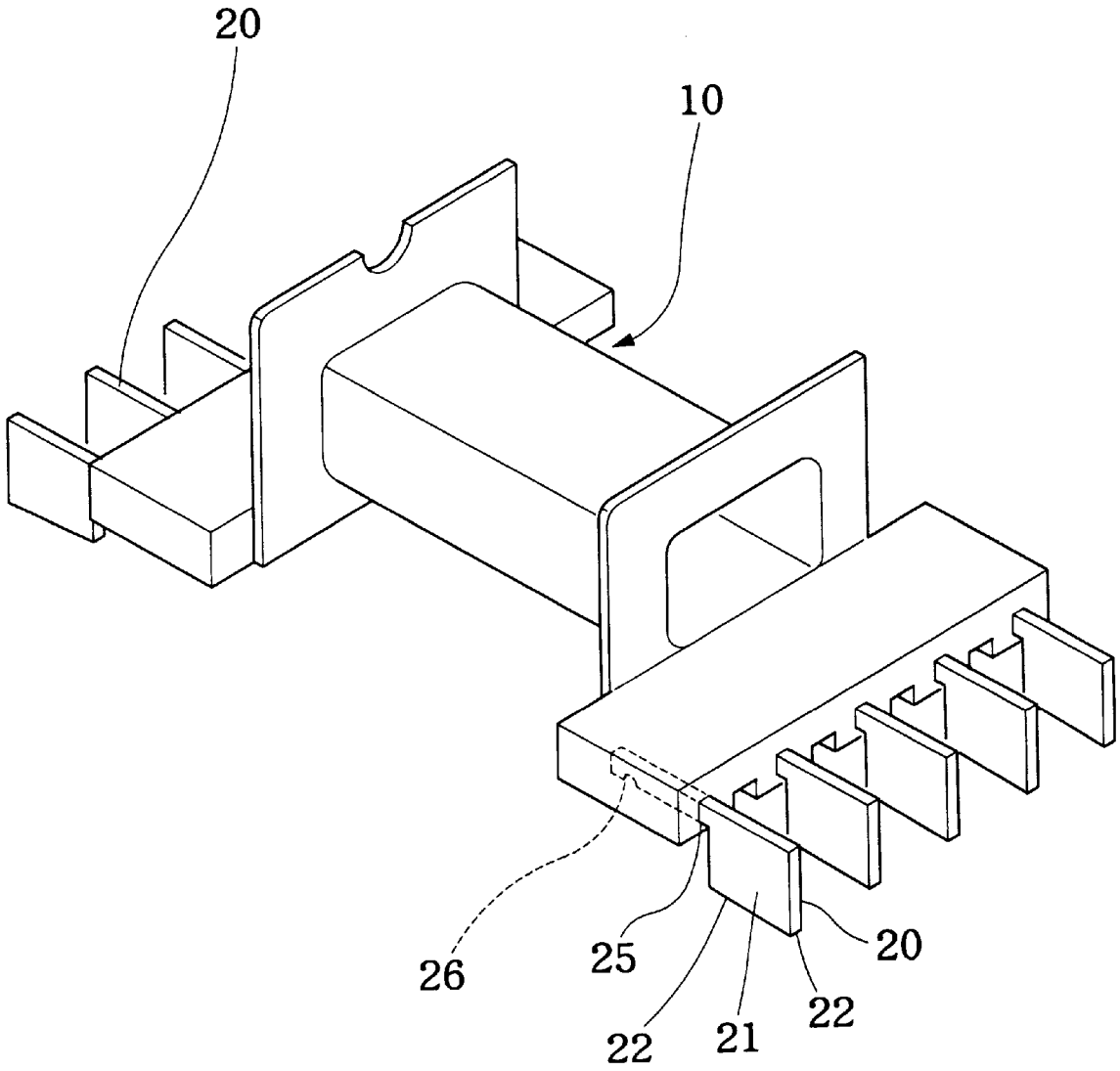
FIG. 6 is a perspective view of another embodiment of the present invention.
Figure 7:
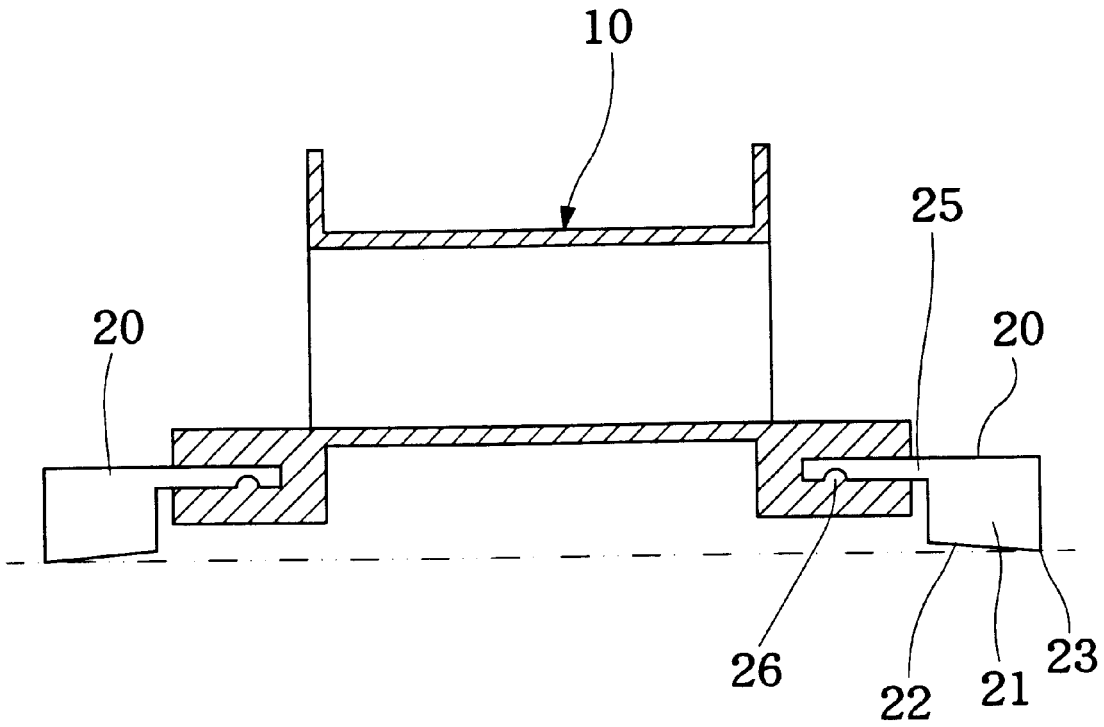
FIG. 7 is a cross section view of another embodiment of the present invention.

The aforementioned connecting pins 20 of the transformer reel may be assembled on the reel body 10 by the connecting pin bodies 21 (as shown in FIGS. 3, 4 and 5). Another, by the supporting frames 25 of the connecting pins 20, connecting pins 20 may be assembled on the reel body 10 (as shown in FIGS. 6 and 7), and at least one rabbet 26 is installed on the supporting frame 25 for increasing the combination between the reel body 10 and the connecting pins 20.

Figure 8:
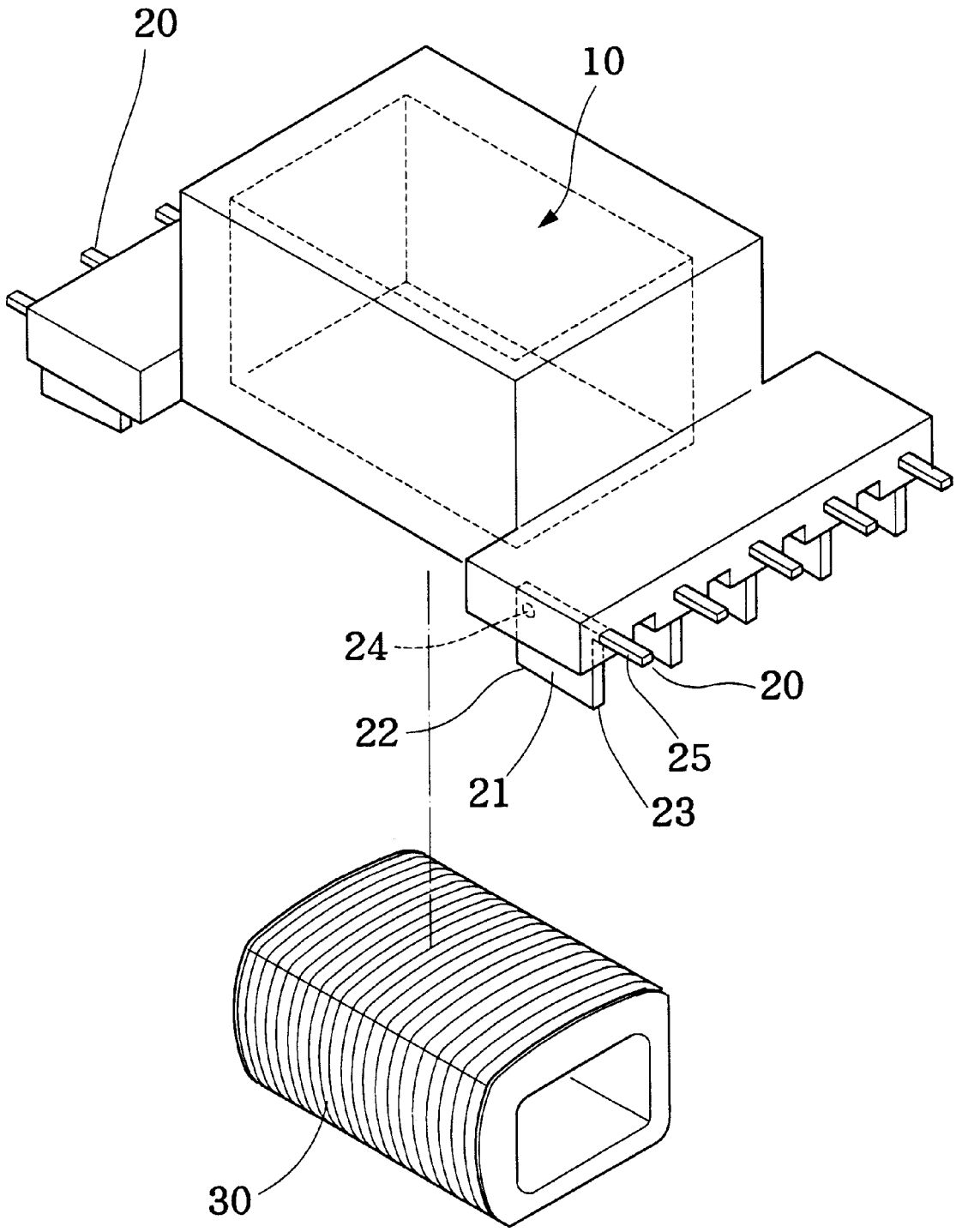
FIG. 8 is a perspective view of a further embodiment of the present invention.
Figure 9:
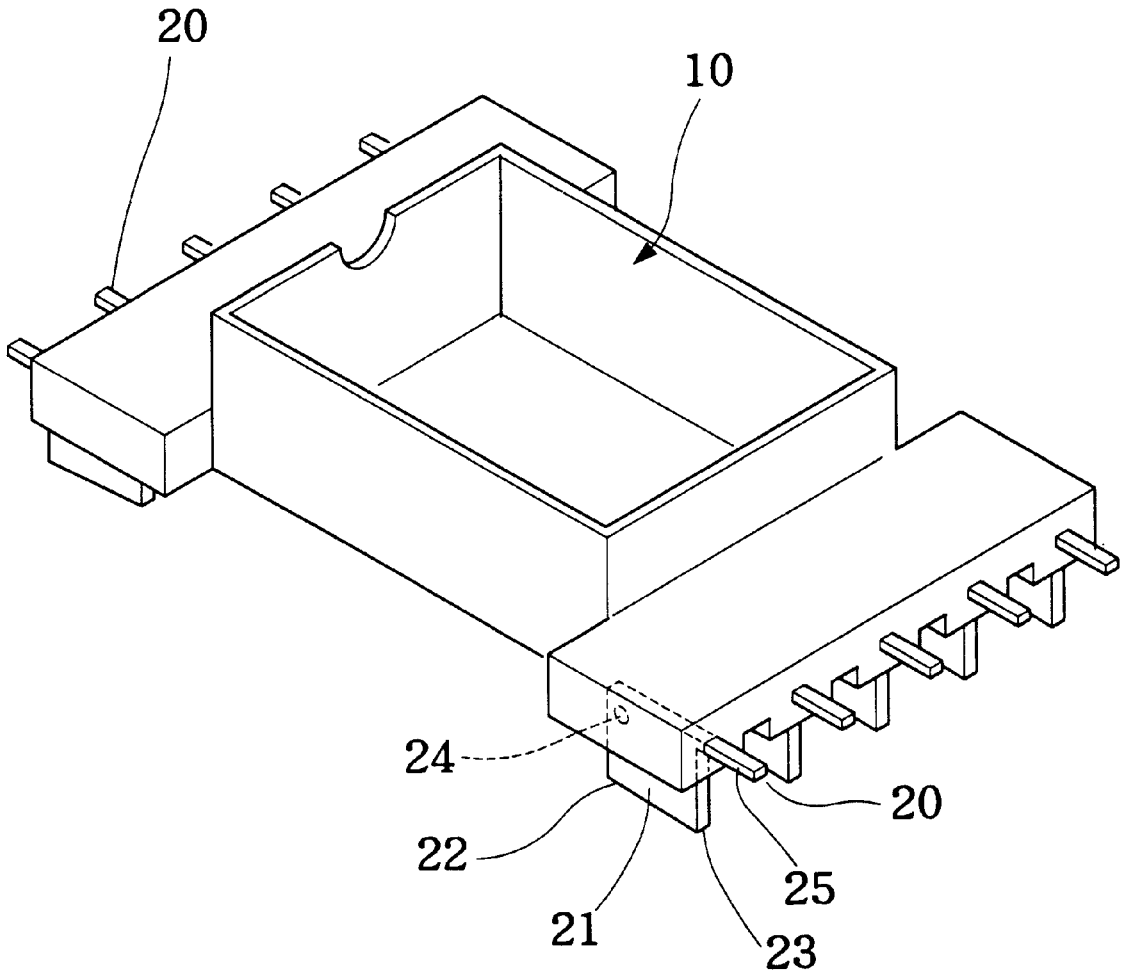
FIG. 9 is a perspective view of a yet embodiment of the present invention.

Moreover, as shown in FIGS. 8 and 9, the reel body 10 of the present invention may be designed as a groove and the winding 30 is wound in advance, then it is assembled within the reel body 10.

The connecting pin structure of the transformer reel of the present invention has at least the following advantages:

1. In manufacturing, only three steps are needed, including the punching of the connecting pins 20, the plating of the connecting pins 20 and the injection of the reel body 10. Thus, the process is simple and manufacturing cost may be reduced greatly. After punching and plating the connecting pin 20, it does not needed to cut the material belt, thus the cutting cross section will not be generated on the connecting pin 20. Therefore, the tin may be plated completely on the connecting pin 20.
2. The connecting pin 20 is made as an individual body by punching, thus a preset is not necessary. Therefore, the different connecting pins 20 may be tightly adjacent with each other on the material belt, so the material is saved. Another, when the reel body 10 is formed on the connecting pins 20 by injections, the preset connecting pins 20 may be directly arranged within the mold by the controlling of a computer, this process also saves more material. Moreover, the distance the reel body 10 and the connecting pins 20 may be varied properly, thus the manufacturing cost is reduced.
3. The connecting pins 20 are directly made by punching, so it is not needed to be bent. Thus, it has a preferred horizontal level. Besides, when the connecting pins 20 is welded on the PC board by surface adhering technology, the connecting pins 20 is contacted with the PC board by a series of lower points 23, therefore, the welding process is simplified and the connecting pins and reel body are connected firmly.

In summary, in the present invention the connecting pins in the prior art has been improved greatly and the manufacturing process is also simplified. Although certain preferred embodiment of the present invention has been shown and described in detail, it should be understood that various changes and modification may be made therein without departing from the scope of the present invention.

Description of the Numerals in Figures.

| | | | |
|---|---|---|---|
| 10 | reel body | 20 | connecting pin |
| 21 | connecting pin body | 22 | lower surface |
| 23 | lower point | 24 | rabbet |
| 25 | supporting frame | 26 | rabbet |
| 30 | winding | 31 | end portion |
| 10a | reel body | 11a | connecting pin |

What is claimed is:

1. An improved structure of connecting pins of a transformer reel comprising:

a reel body having a winding support means for supporting a transformer winding, said reel body further having a connecting pin support frame formed thereon;

a plurality of connecting pins, each of said connecting pins having a connecting pin body, said connecting pin body having an upper edge and a lower edge, said upper edge having a rabbet formed therethrough for fixedly securing said connecting pin body to said connecting pin support frame, said upper edge further having a horizontal support frame projecting therefrom, said horizontal support frame providing further support between said connecting pin body and said connecting pin support frame, said lower edge being substantially linearly inclined to form a lower point such that said lower point solely makes contact with a supporting surface, for simplifying a weld contact between said connecting pin body and said supporting surface.

2. The improved structure of connecting pins of a transformer reel as recited in claim 1, wherein each of said horizontal support frames has a rabbet formed therethrough for providing further securement between said reel body and said connecting pins.

3. The improved structure of connecting pins of a transformer reel as recited in claim 1, wherein the transformer winding has end portions, each of said end portions fixedly secured to said horizontal support frames.

4. The improved structure of connecting pins of a transformer reel as recited in claim 1, wherein the reel body has a groove shape for assembling with said transformer winding.

* * * * *